US011154446B2

(12) United States Patent
Edwards

(10) Patent No.: US 11,154,446 B2
(45) Date of Patent: Oct. 26, 2021

(54) PORTABLE TRANSFER CHAIR AND LIFT

(71) Applicant: Dana J. Edwards, Toms River, NJ (US)

(72) Inventor: Dana J. Edwards, Toms River, NJ (US)

( * ) Notice: Subject to any disclaimer, the term of this patent is extended or adjusted under 35 U.S.C. 154(b) by 56 days.

(21) Appl. No.: 16/549,698

(22) Filed: Aug. 23, 2019

(65) Prior Publication Data

US 2020/0060911 A1 Feb. 27, 2020

Related U.S. Application Data

(60) Provisional application No. 62/723,062, filed on Aug. 27, 2018, provisional application No. 62/805,383, filed on Feb. 14, 2019.

(51) Int. Cl.
*A61G 7/10* (2006.01)

(52) U.S. Cl.
CPC ..... *A61G 7/1023* (2013.01); *A61G 7/1007* (2013.01); *A61G 7/1059* (2013.01)

(58) Field of Classification Search
CPC .. A61G 7/1023; A61G 7/1007; A61G 7/1059; A61G 1/044; A61G 1/048
See application file for complete search history.

(56) References Cited

U.S. PATENT DOCUMENTS 3,859,677 A 1/1975 Nordwig
4,944,057 A 7/1990 Shaw
5,515,549 A 5/1996 Wang
5,579,546 A 12/1996 Griskauskas
5,978,989 A * 11/1999 Chavez ..... A61G 1/01 294/140
6,055,685 A 5/2000 Norton et al.
6,276,006 B1 8/2001 Hoit
6,289,534 B1 * 9/2001 Hakamiun ..... A61G 7/1017 5/83.1
6,532,610 B1 3/2003 Calfas et al.
6,901,612 B2 6/2005 Calfas et al.
7,624,458 B2 12/2009 Felling
8,281,430 B1 * 10/2012 Hough ..... A61G 7/1051 5/89.1
10,080,700 B1 * 9/2018 Bagheri ..... A61H 3/008

OTHER PUBLICATIONS

"Webbing." Merriam-Webster.com Dictionary, Merriam-Webster, https://www.merriam-webster.com/dictionary/webbing. Accessed Dec. 14, 2020.*

* cited by examiner

*Primary Examiner* — David R Hare
*Assistant Examiner* — Madison Emanski
(74) *Attorney, Agent, or Firm* — Meagher Emanuel Laks Goldberg & Liao, LLP

(57) ABSTRACT

According to various embodiments, a portable chair for a disabled individual is disclosed. The portable chair includes a webbing configured to support at least a back and legs of the individual and a plurality of handles around the webbing and weaved together to support the webbing. The handles are configured for lifting the individual.

17 Claims, 14 Drawing Sheets

PORTABLE TRANSFER CHAIR AND LIFT

CROSS-REFERENCE TO RELATED APPLICATIONS

This application claims priority to provisional applications 62/723,062 and 62/805,383, filed Aug. 27, 2018 and Feb. 14, 2019, respectively, which are herein incorporated by reference in their entirety.

FIELD OF THE INVENTION

The present invention relates generally to transfer devices and, more particularly, to a portable transfer chair and lift for individuals with disabilities.

BACKGROUND OF THE INVENTION

Individuals with physical disabilities such as Duchenne muscular dystrophy (DMD), amyotrophic lateral sclerosis (ALS), spinal muscular atrophy (SMA), and quadriplegia have significantly limited mobility and typically require a caregiver to transfer them in and out of their wheelchair and bed. Individuals other than small children (or those who can support some of their own weight) cannot be lifted and transferred by a caregiver without additional equipment. In these circumstances, a patient lift, or Hoyer lift is used. These devices include a sling attached to a manual or electric lift on wheels and allow individuals to be transferred by a caregiver. However, these devices are expensive (ranging in cost from $500 to $9,000) and limited to use in areas that have enough space to maneuver the device. Even more, use of Hoyer lifts outside the home, within the community, and during travel is not practical.

Alternatively, the MegaMover is a portable patient transport device that aims to improve upon some of the limitations of conventional Hoyer lifts. This device is a chair made of non-woven material with nylon-reinforced straps to allow multiple caregivers to easily lift and transport an individual. Though the MegaMover can be used to transfer an individual in an emergency situation or when the use of a Hoyer lift is not practical, it is not well suited for daily use by an individual with a disability. The chair does not have a commode cut-out and therefore is difficult to use in the bathroom as the sling needs to be fully removed then repositioned under the individual before and after use of the bathroom. This is time consuming, uncomfortable for the individual, and burdensome for the caregiver. Additionally, the material of the chair renders use in the shower and transferring in and out of a pool impractical because the water collects under the seat without draining and makes it challenging to dry the individual. Furthermore, transferring from the shower or pool back into a wheelchair will cause the wheelchair seat to get wet, which can be difficult to dry and expensive to clean or replace.

As such, there is a need for a portable transfer chair and lift for individuals with disabilities that addresses the above challenges.

SUMMARY OF THE INVENTION

According to various embodiments, a portable chair for a disabled individual is disclosed. The portable chair includes a webbing configured to support at least a back and legs of the individual and a plurality of handles around the webbing and weaved together to support the webbing. The handles are configured for lifting the individual.

According to various embodiments, a portable transfer sling for a disabled individual is disclosed. The portable sling includes a webbing configured to support at least a back and legs of the individual, a plurality of handles around the webbing and weaved together to support the webbing, the handles configured for lifting the individual, and a plurality of loops stitched together with each handle of the plurality of handles.

According to various embodiments, a portable transfer lift for a disabled individual is disclosed. The portable transfer lift includes a flat webbing configured to roll under and support at least a back and legs of the individual and a plurality of handles around the webbing and weaved together to support the webbing. The handles are configured for lifting the individual.

Various other features and advantages will be made apparent from the following detailed description and the drawings.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only exemplary embodiments of the invention and are not, therefore, to be considered to be limiting its scope, the invention will be described and explained with additional specificity and detail through the use of the accompanying drawings, in which.

DETAILED DESCRIPTION OF THE INVENTION

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for illustrative purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments.

Figure 1A:
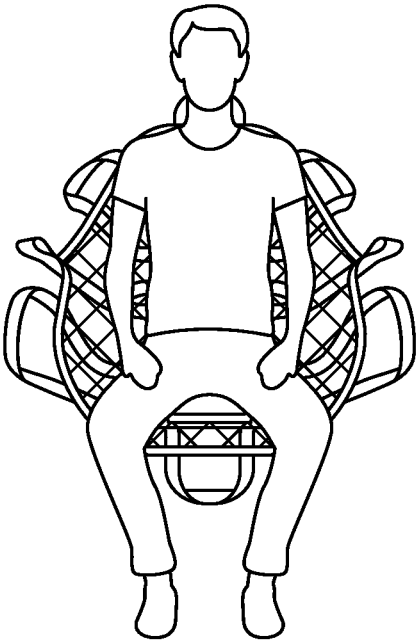
FIGS. 1A-1G depict schematic diagrams of a portable transfer chair according to an embodiment of the present invention.
Figure 1B:
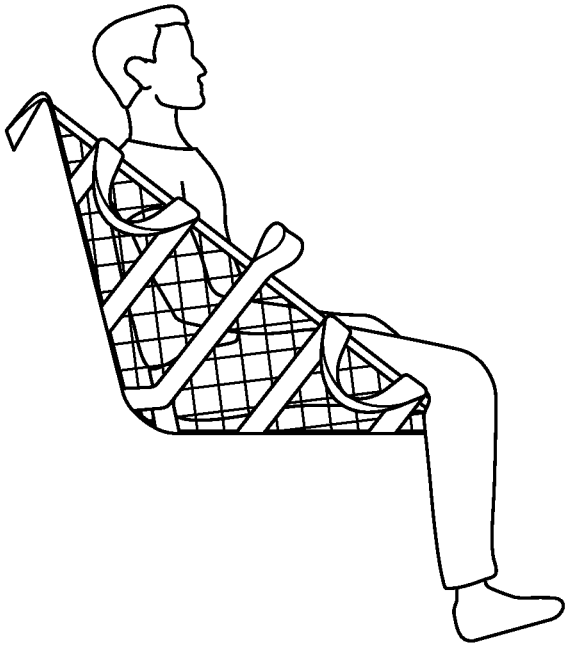
Figure 1C:
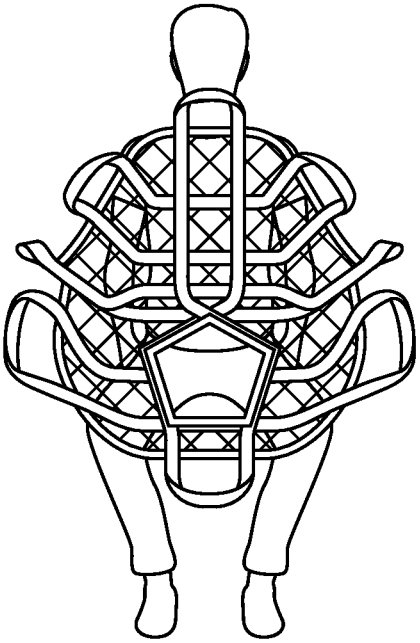
Figure 1D:
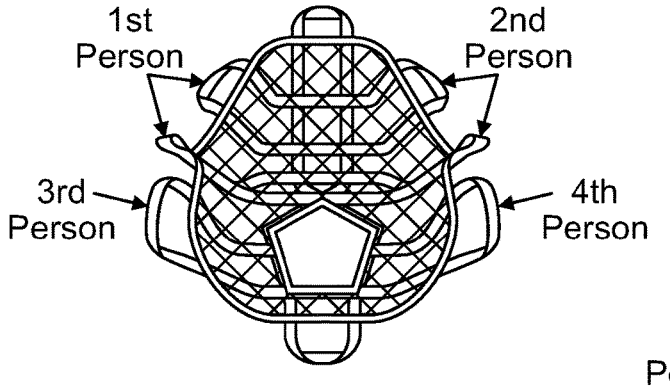
Figure 1E:
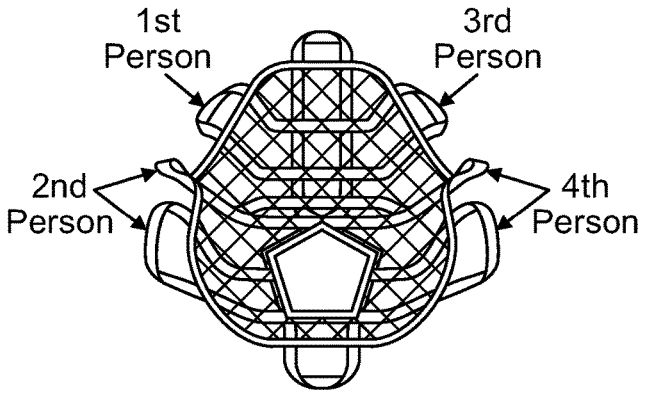
Figure 1F:
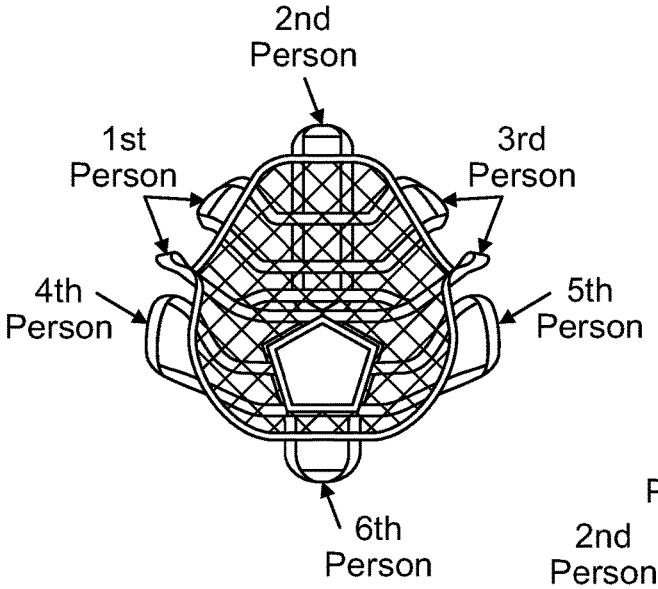
Figure 1G:
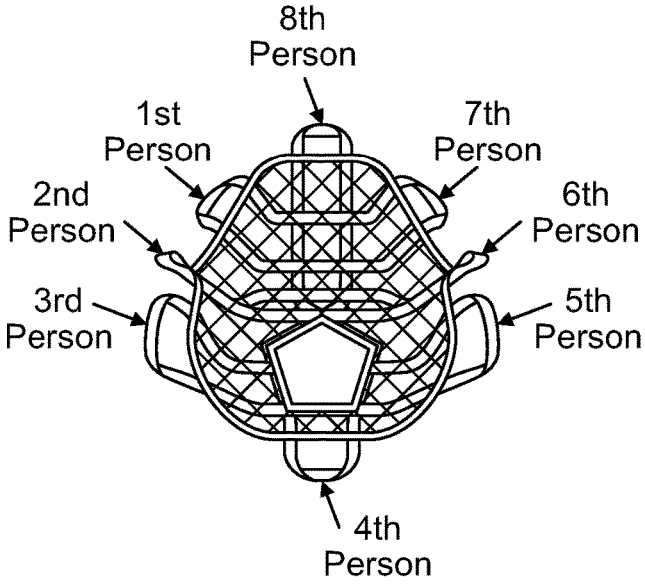
Figure 2A:
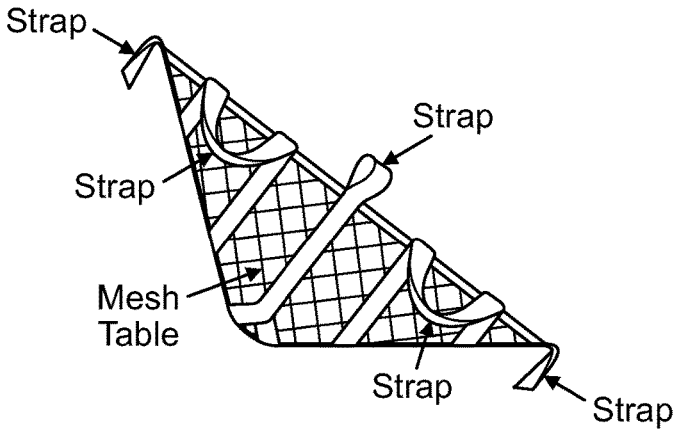
FIGS. 2A-2G depict additional schematic diagrams of the portable transfer chair according to an embodiment of the present invention.
Figure 2B:
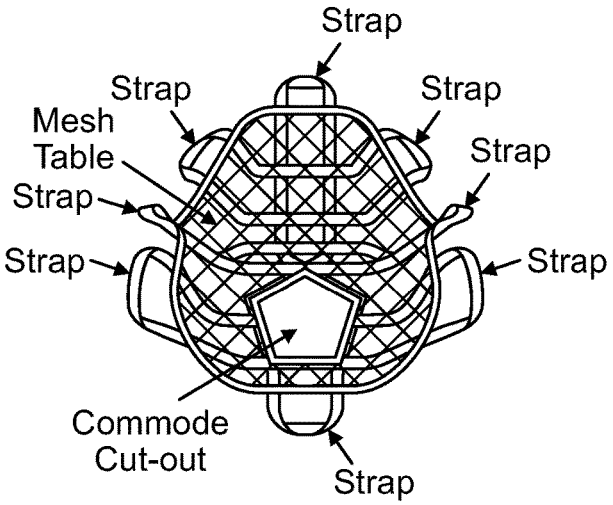
Figure 2C:
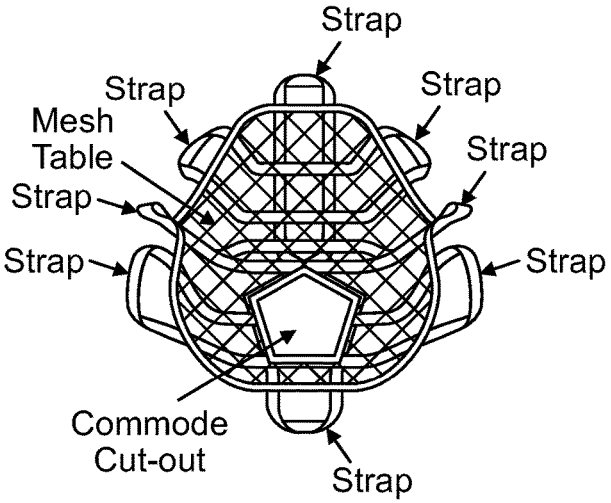
Figure 2D:
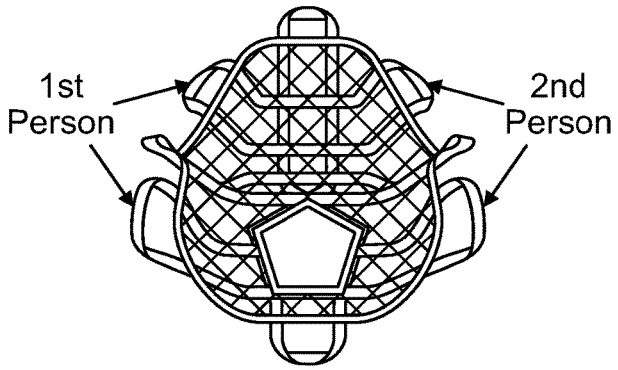
Figure 2E:
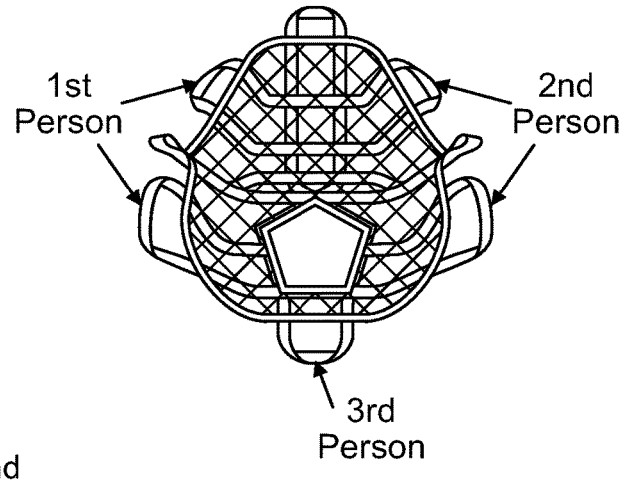
Figure 2F:
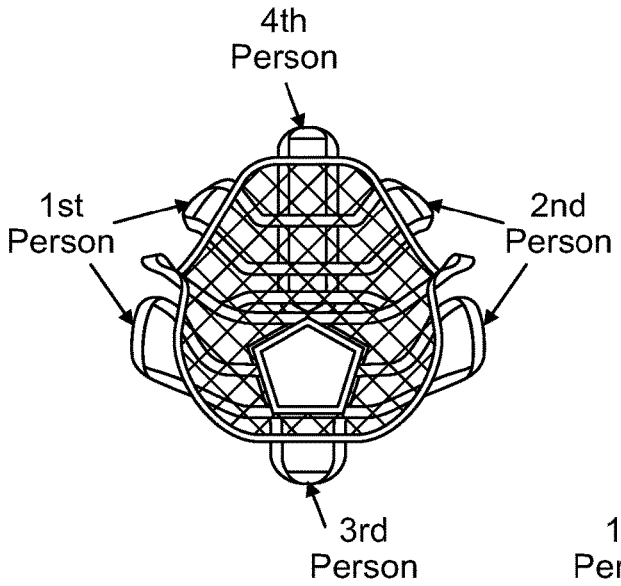
Figure 2G:
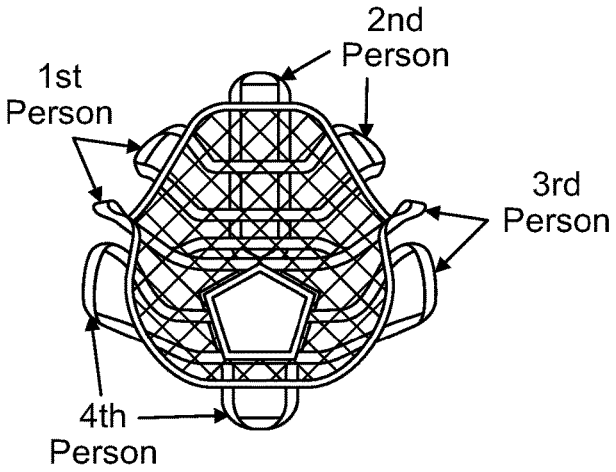

FIGS. 1A-1G and FIGS. 2A-2G depict schematic diagrams of a portable transfer chair. FIGS. 1A-1C depict different perspectives where an individual is in the portable transfer chair. FIGS. 1D-1G depict different ways to carry the individual. FIGS. 2A-2C depict different perspective without the individual included. FIGS. 2D-2G depict additional different ways to carry the individual. The portable transfer chair allows for between two and eight people to carry. It is made of a water resistant, light weight polypropylene webbing about 1.5" wide and Phifertex 1711 open weave about 48" and 54" wide with stitching that is 138 Sunstop N-wck UV SO-JT Blk thread. The portable transfer chair weighs only about one pound, but can hold up to and at least 300 pounds.

Figure 3:
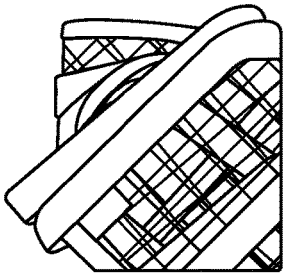
FIG. 3 depicts a perspective view of a fully folded portable transfer chair according to an embodiment of the present invention.
Figure 4:
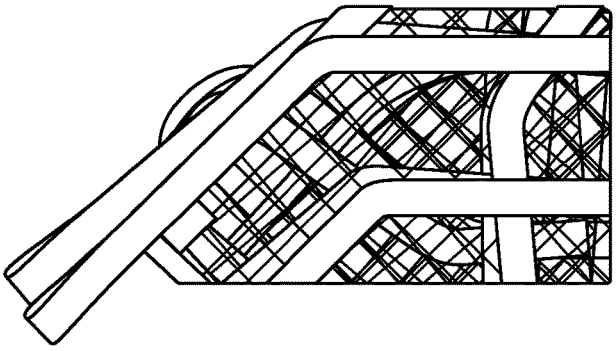
FIG. 4 depicts a perspective view of a partially folded portable transfer chair according to an embodiment of the present invention.
Figure 5:
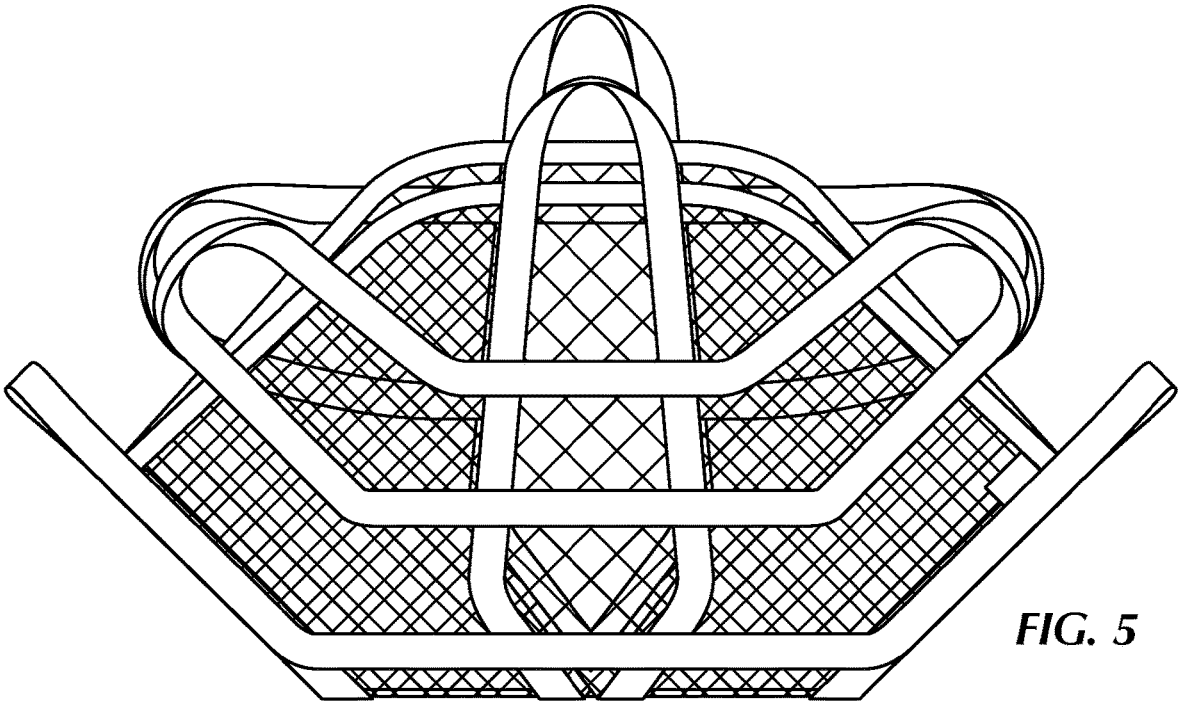
FIG. 5 depicts a perspective view of a partially folded portable transfer chair according to an embodiment of the present invention.

The portable transfer chair can also be conveniently folded for ease of carrying. FIGS. 3-5 depict the portable transfer chair in different folded states.

Figure 6:
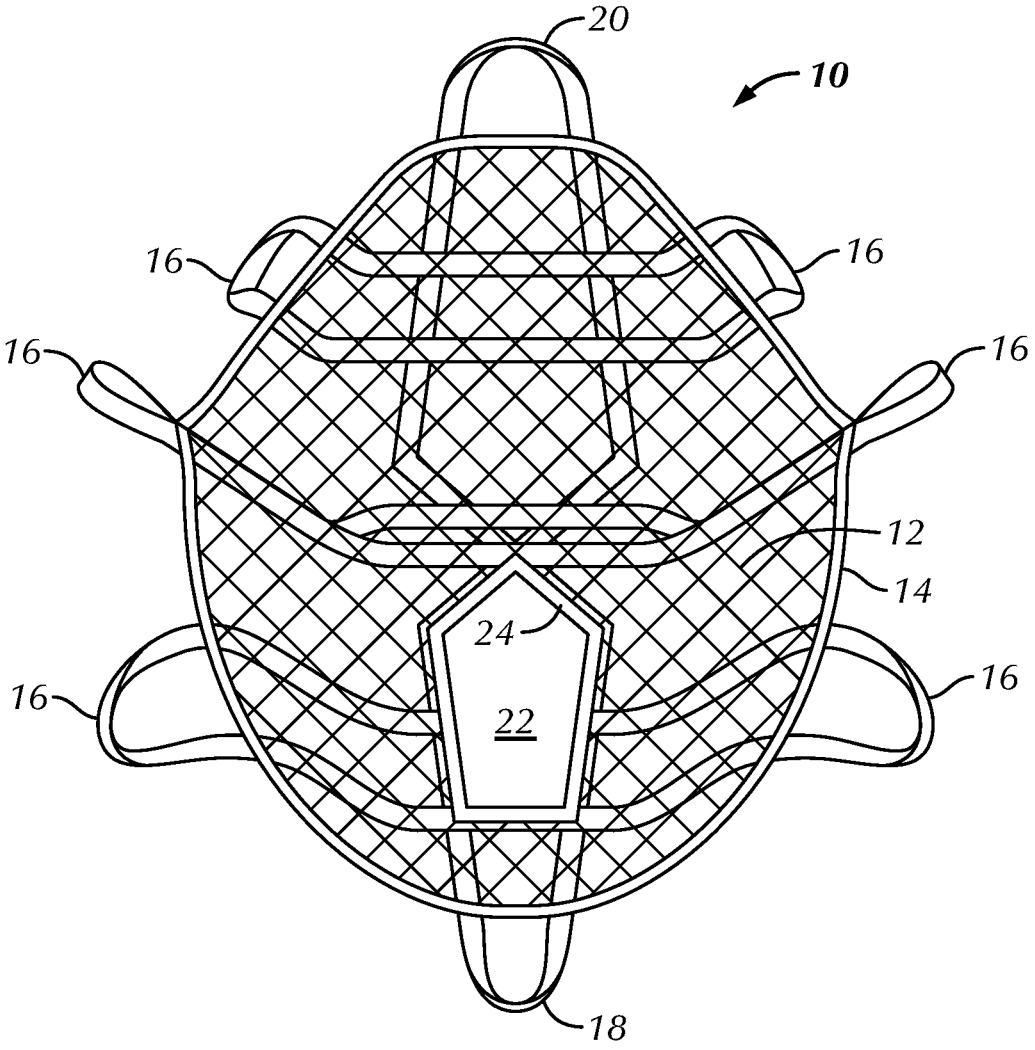
FIG. 6 depicts a perspective view of an unfolded portable transfer chair according to an embodiment of the present invention.

FIG. 6 depicts a perspective view of an unfolded portable transfer chair 10. The portable transfer chair 10 includes a webbing 12 for supporting an individual. The webbing 12 should be designed to provide back support as well as leg support for the individual. The portable transfer chair 10 further includes an outline weave 14 around the webbing to hold the chair together. The portable transfer chair 10 also includes a number of handles made of the same fabric as the outline weave 14. As illustrated, eight handles are included, with six side handles 16, a front handle 18, and a back handle 20. The side handles 16 are weaved together, and the front handle 18 and back handle 20 are weaved together, with the weaving crossing to support the webbing 12.

Figure 7:
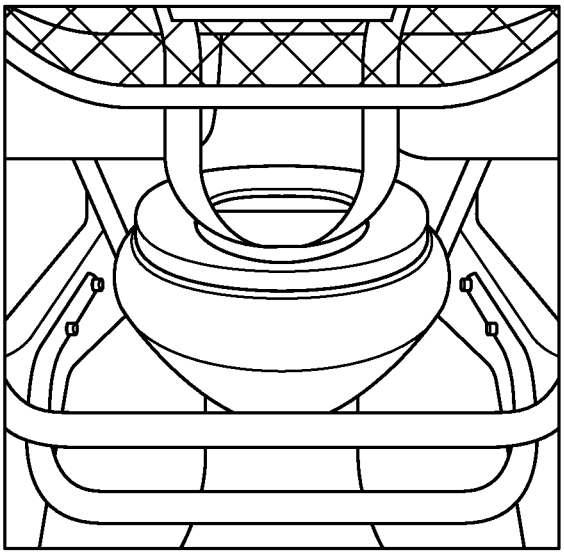
FIG. 7 depicts a front view of the portable transfer chair above a toilet according to an embodiment of the present invention.

A commode 22 is included as well to allow bathroom use anywhere. The commode 22 also includes an outline weave 24. FIG. 7 depicts a front view of the portable transfer chair above a toilet.

Figure 8:
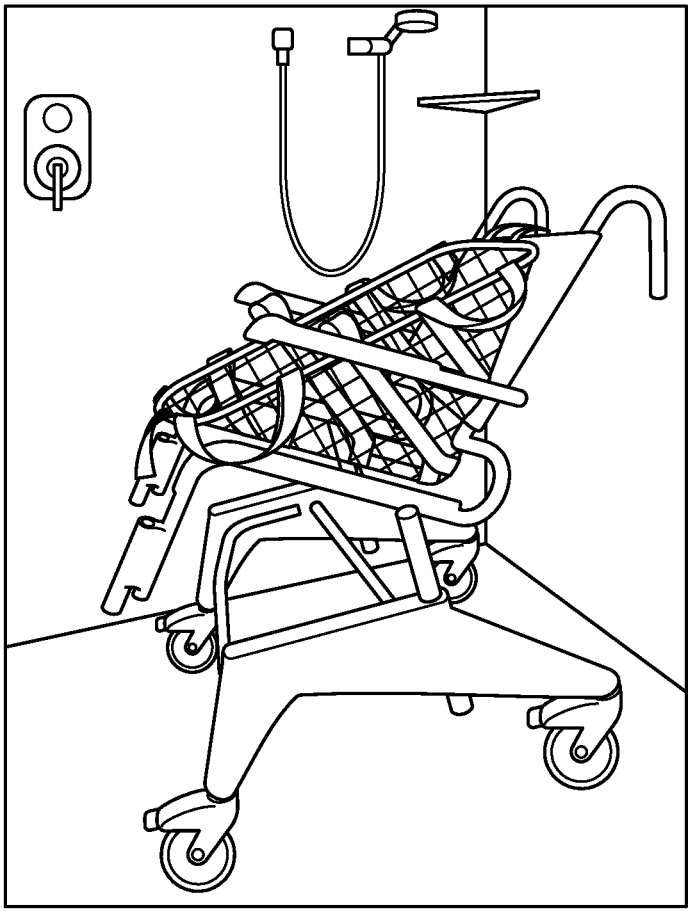
FIG. 8 depicts a side view of the portable transfer chair in a shower according to an embodiment of the present invention.
Figure 9:
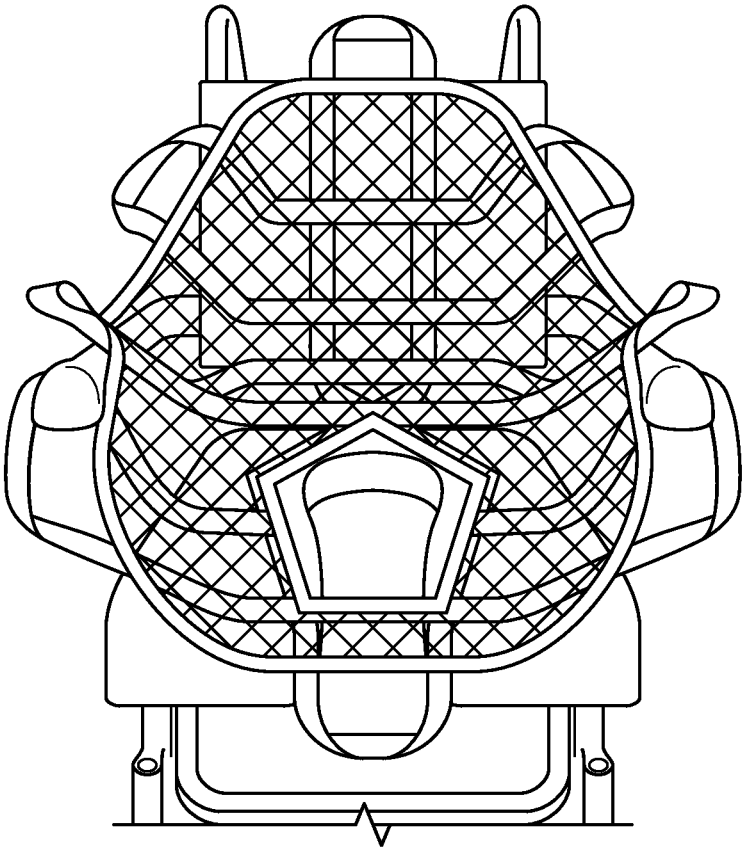
FIG. 9 depicts a front view of the portable transfer chair in the shower according to an embodiment of the present invention.

The webbing 12 provides for easy drainage to make showering or going into a pool easy and safe. FIGS. 8 and 9 depict different views of the portable transfer chair as can be utilized in a shower.

Figure 10:
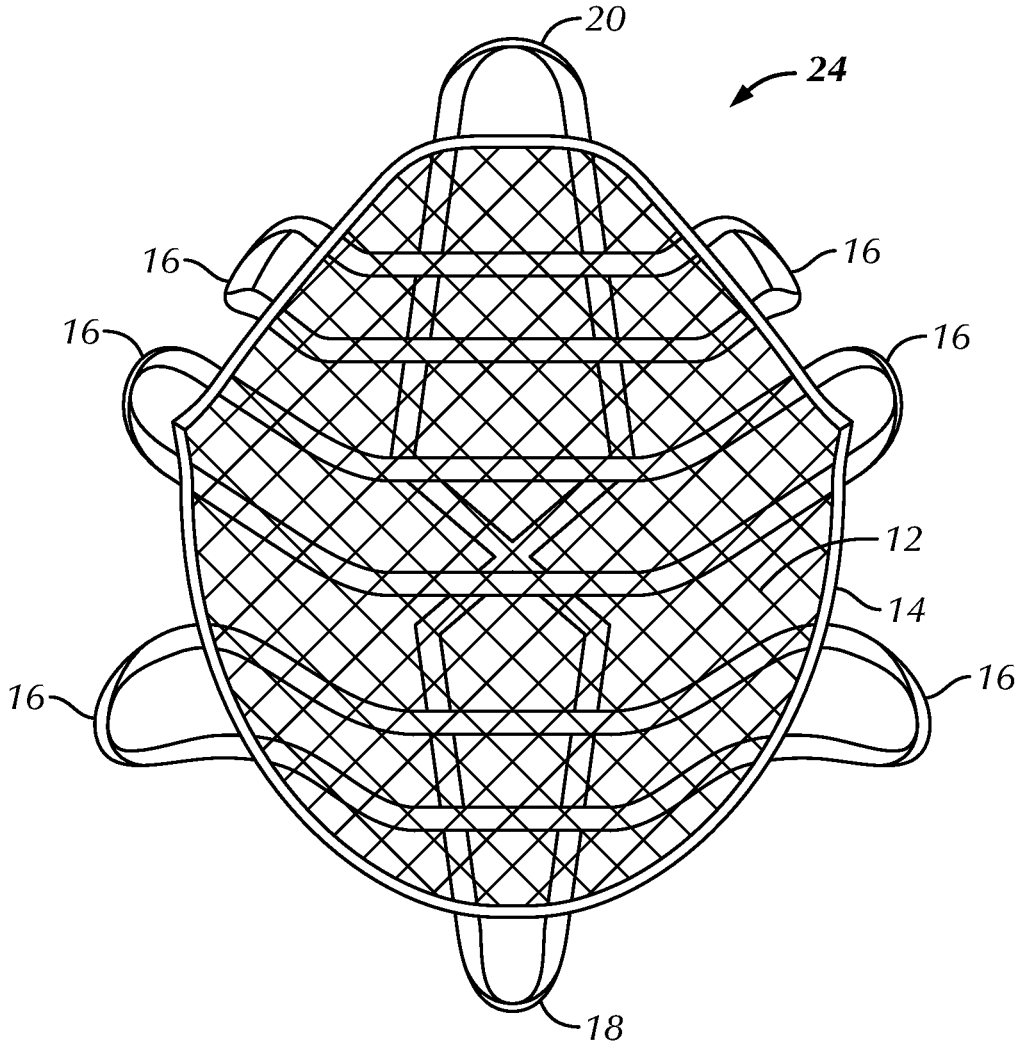
FIG. 10 depicts a schematic diagram of an emergency transfer chair according to an embodiment of the present invention.
Figure 11:
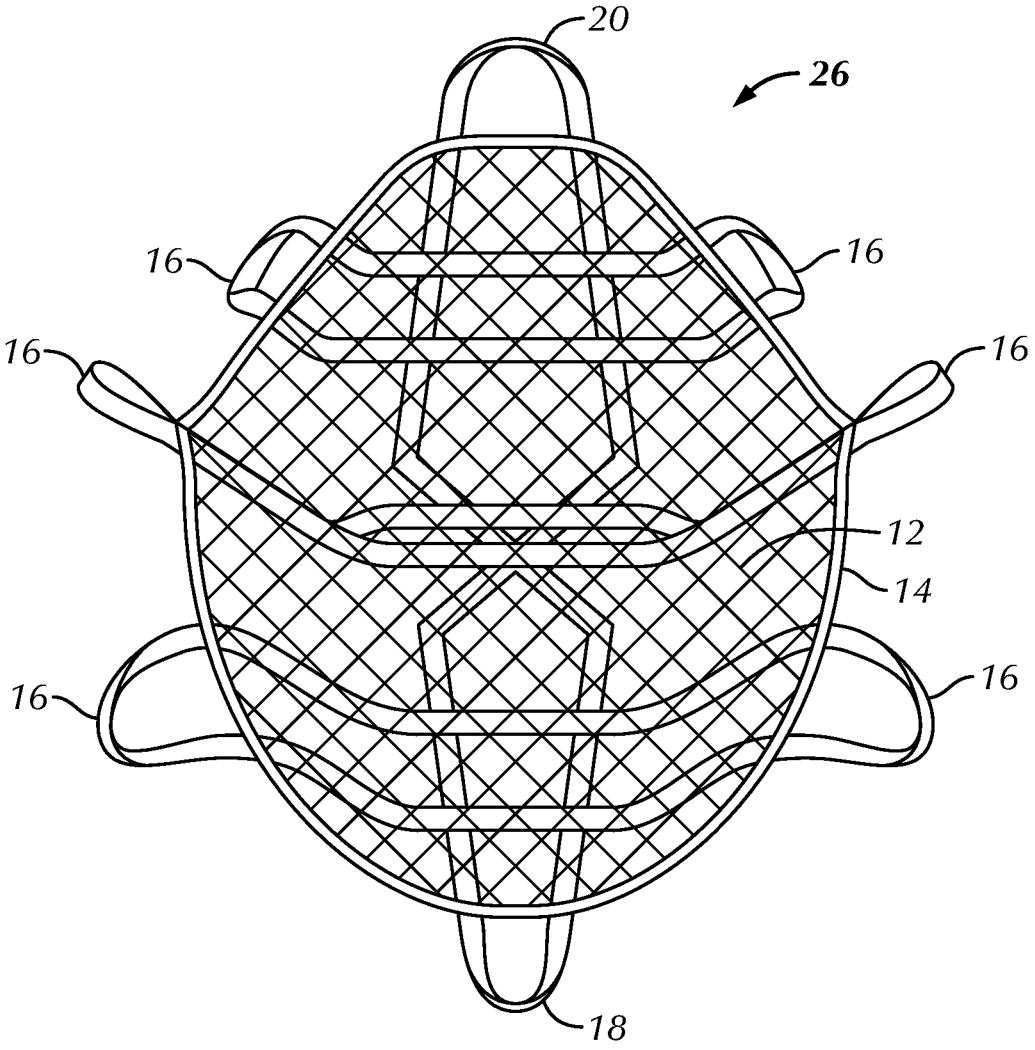
FIG. 11 depicts a front view of the emergency transfer chair according to an embodiment of the present invention.

FIG. 10 depicts a schematic diagram of an emergency transfer chair and FIG. 11 depicts a front view of the emergency transfer chair 26, which was made to perform rescues in any situation. The emergency transfer chair 26 is constructed similar to the portable transfer chair 10 but larger and without the commode. For instance, the emergency transfer chair can take up about 51 by 45 inches of space while the portable transfer chair 10 can take up about 39 by 36.5 inches of space. The emergency transfer chair can also allow for between two and eight people to carry. It is made of a water resistant, lightweight polypropylene webbing 1.5" wide and Phifertex 1711 open weave 48" and 54" wide with stitching that is 138 Sunstop N-wck UV SO-JT Blk thread. The emergency chair 26 weighs about 1.5 pounds and can also fold up.

Figure 12:
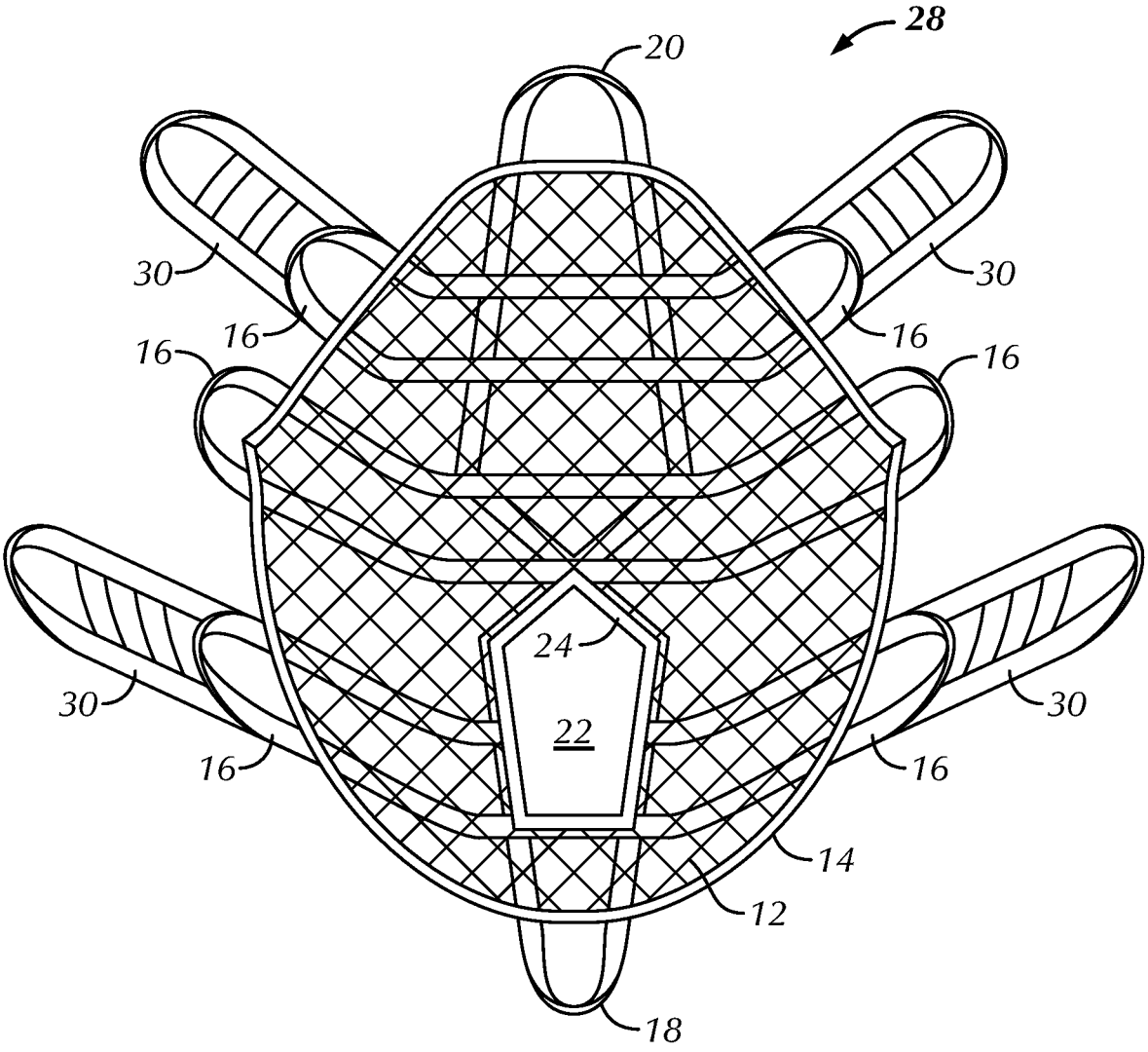
FIG. 12 depicts a schematic diagram of a portable transfer sling according to an embodiment of the present invention.

FIG. 12 depicts a schematic diagram of a portable transfer sling 28, designed to be used in conjunction with a Hoyer Lift or track ceiling. The design is similar to the portable transfer chair 10, but has an additional 3 or 4 extra loops 30 included in the top side handles and bottom side handles. The transfer sling 28 is also made of water resistant lightweight polypropylene webbing 1.5" wide and Phifertex 1711 open weave 48" and 54" wide with stitching that is 138 Sunstop N-wck UV SO-JT Blk thread. It weighs about 1.5 pounds. The sling 28 also has a commode 22 cut out. The sling 28 allows a single person to move a person in an upright and secure position so when put on a toilet they are upright and feel comfortable.

Figure 13:
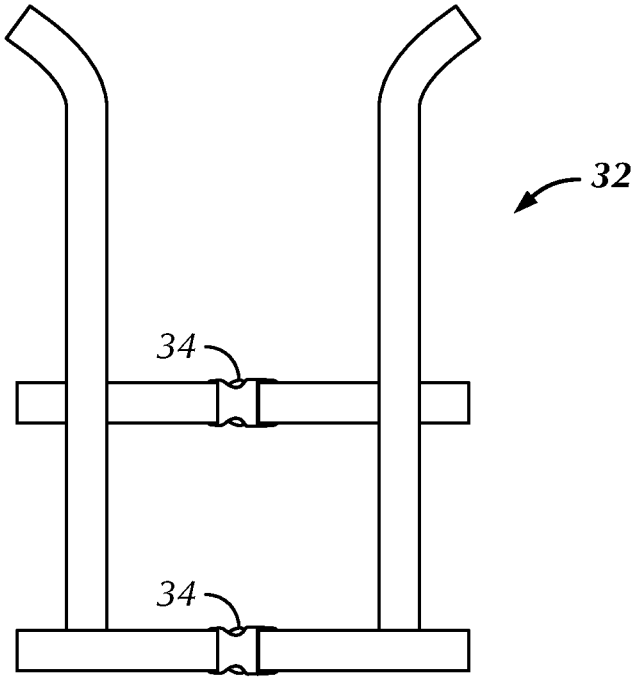
FIG. 13 depicts a schematic diagram of a military transfer chair according to an embodiment of the present invention.
Figure 14:
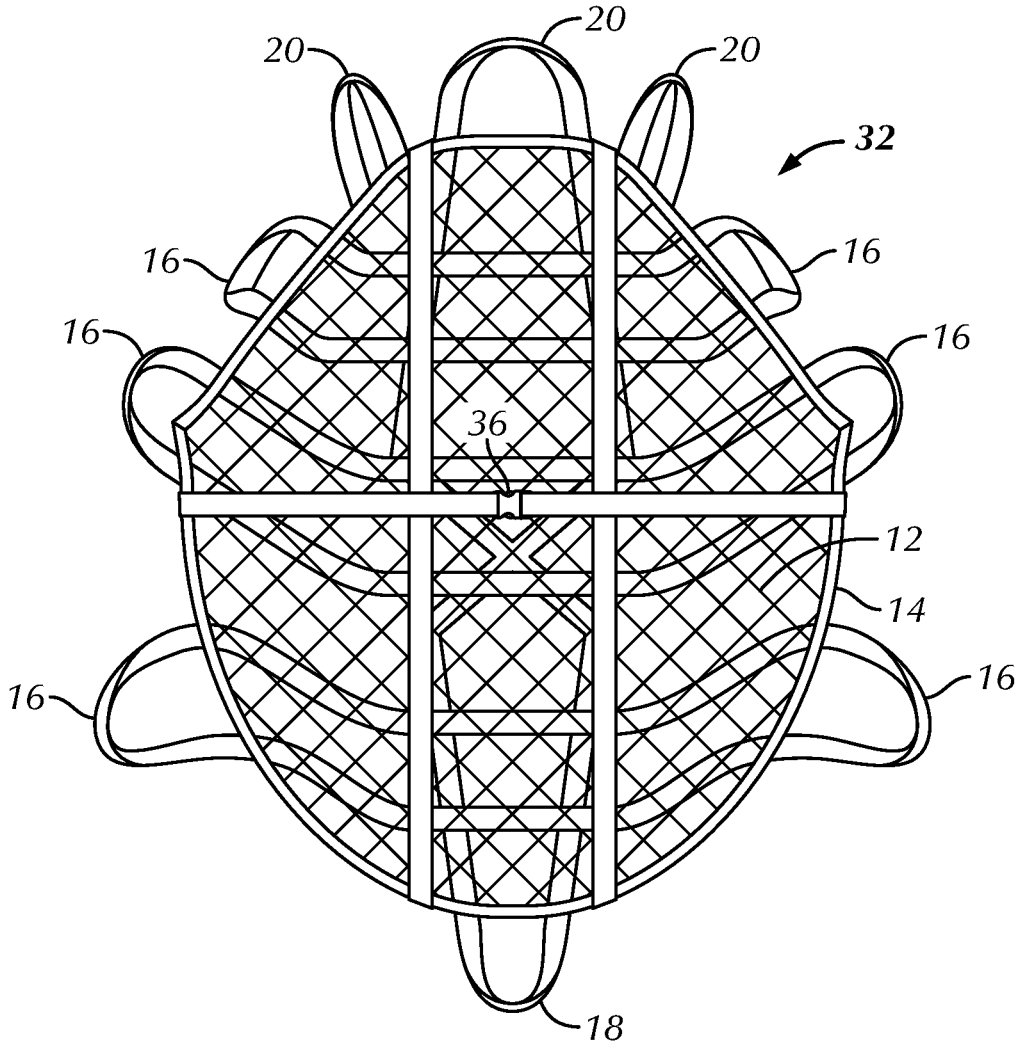
FIG. 14 depicts another schematic diagram of the military transfer chair according to an embodiment of the present invention.

FIGS. 13 and 14 depict schematic diagrams of a military transfer lift 32, which was designed for a person in combat to safely carry out someone without needing any other assistance. It is made of water resistant, lightweight polypropylene webbing 1.5" wide and Phifertex 1711 open weave 48" and 54" wide with stitching that is 138 Sunstop N-wck UV SO-JT Blk thread. This lift 32 weighs about 2 pounds. It has YKK 10-1 inch flat heavy duty dual adjustable side release plastic buckles. The buckles include two front buckles 34 in the front of the person being rescued and one back buckle 36 in the middle of back going over shoulders and around lugs like a back pack. This will allow a person to rescue someone and go through any type of conditions with their hands free.

Figure 15:
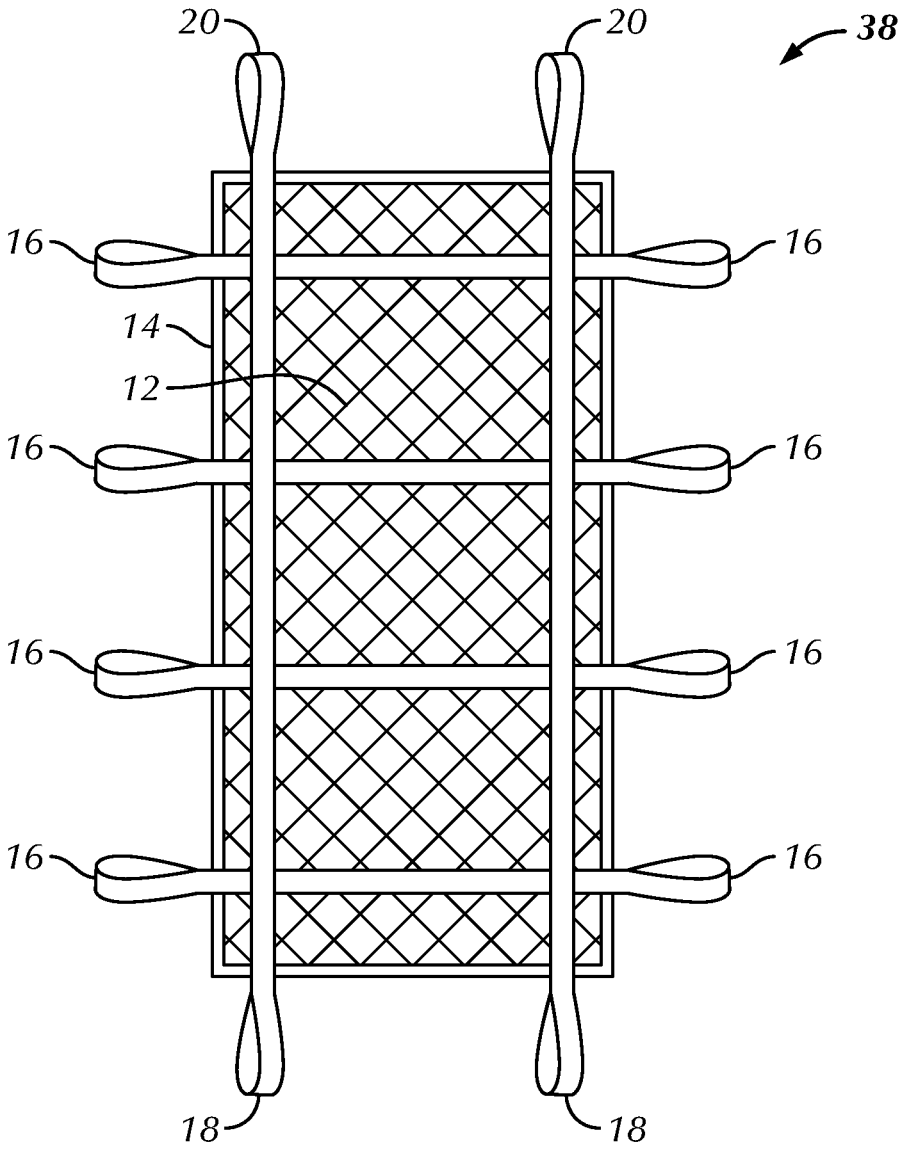
FIG. 15 depicts a schematic diagram of a portable transfer flat lift according to an embodiment of the present invention.

FIG. 15 depicts a schematic diagram of a portable transfer flat lift 38 according to an embodiment of the present invention. The flat lift 38 is designed to easily roll under and transfer someone in an emergency situation where an individual cannot be in an upright position. This lift 38 is also made of water resistant, lightweight polypropylene webbing 1.5" wide and Phifertex 1711 open weave wide with stitching that is 138 Sunstop N-wck UV SO-JT Blk thread. The flat lift 38 is 6 ft by 3 ft and is rectangularly shaped, though other shapes can be used as well. The flat lift can allow for between 2 and 12 people to assist in transferring the individual.

Most people with disabilities are stuck in their wheelchair or in one spot all day long. The portable transfer chairs and lifts as described makes these people's lives better by providing mobility that was not possible before. They can be walked into their pool, transferred on a boat, on a ride, on a plane, and get in and out of the ocean, all done easily and safely. The transfer chairs and lifts are great for caregivers, nursing homes, hospitals, and for physical therapists to transfer patients to and from a chair to a pool for aqua therapy. The portable transfer chairs and lifts will save the backs of caregivers and can be a lifesaver in emergency situations. Lifeguards could use it when rescuing a person who is drowning. The portable transfer chairs and lifts can be used for all different types of diseases like muscular dystrophy multiple sclerosis, cerebral palsy, for veterans, elderly, and quadriplegics. It also can be used by physical therapists, nursing homes, schools, hospitals, lifeguards, and camps. In addition, it is affordable and does not require complicated assembly.

It is understood that the above-described embodiments are only illustrative of the application of the principles of the present invention. The present invention may be embodied in other specific forms without departing from its spirit or essential characteristics. All changes that come within the meaning and range of equivalency of the claims are to be embraced within their scope. Thus, while the present invention has been fully described above with particularity and detail in connection with what is presently deemed to be the most practical and preferred embodiment of the invention, it will be apparent to those of ordinary skill in the art that numerous modifications may be made without departing from the principles and concepts of the invention as set forth in the claims.

What is claimed is:

1. A portable chair for a disabled individual comprising: a webbing configured to support at least a back and legs of the individual; a first outline weave surrounding the webbing, the first outline weave being a different material than the webbing to contain and support the webbing; and a plurality of handles around the webbing and weaved together to support the webbing when lifting the individual, the plurality of handles comprising: at least one front handle connected to a front of the first outline weave, at least one back handle connected to a back of the first outline weave, and at least two side handles connected on each side of the first outline weave, the front handle and back handle connecting to each other via a support weave within the webbing and each side handle connecting to its respective opposing side handle via additional support weaves within the webbing, the support weaves being the same material as the first outline weave; a commode interposed within the webbing; and a second outline weave forming a closed perimeter surrounding the commode, the support weave connecting the front handle to the back handle being directly connected to the closed perimeter of the second outline weave, the second outline weave being the same material as the first outline weave.

2. The portable chair of claim 1, wherein the plurality of handles comprises an additional side handle on each side of the outline weave.

3. The portable chair of claim 1, wherein the webbing comprises a water resistant polypropylene webbing.

4. The portable chair of claim 1, further comprising a plurality of loops, each loop connected between a respective side handle and the outline weave.

5. The portable chair of claim 1, further comprising a plurality of buckles connected to the webbing for securing the individual.

6. The portable chair of claim 1, wherein the first outline weave and support weaves comprise an open weave with non-wick stitching.

7. A portable transfer sling for a disabled individual comprising: a webbing configured to support at least a back and legs of the individual; an outline weave surrounding the webbing, the outline weave being a different material than the webbing to contain and support the webbing; a plurality of handles around the webbing and weaved together to support the webbing when lifting the individual, the plurality of handles comprising: at least one front handle connected to a front of the outline weave, at least one back handle connected to a back of the outline weave, and at least two side handles connected on each side of the outline weave, the front handle and back handle connecting to each other via a support weave within the webbing and each side handle connecting to its respective opposing side handle via additional support weaves within the webbing, the support weaves being the same material as the outline weave; and a plurality of loops, each loop surrounding an outer perimeter of a respective side handle such that each loop is directly connected to its respective side handle at the outline weave but each side handle is directly positioned between the outline weave and its respective loop, such that an outer perimeter of each of the plurality of loops surrounds and extends outward from the outer perimeter of its respective side handle.

8. The portable sling of claim 7, wherein the plurality of handles comprises an additional side handle on each side of the outline weave.

9. The portable sling of claim 7, further comprising a commode.

10. The portable sling of claim 9, further comprising a second outline weave forming a closed perimeter surrounding the commode.

11. The portable sling of claim 7, wherein the webbing comprises a water resistant polypropylene webbing.

12. The portable sling of claim 7, wherein the outline weave and support weaves comprise an open weave with non-wick stitching.

13. A portable chair for a disabled individual comprising:

a webbing configured to support at least a back and legs of the individual;

a first outline weave surrounding the webbing, the first outline weave being a different material than the webbing to contain and support the webbing; and a plurality of handles around the webbing and weaved together to support the webbing when lifting the individual, the plurality of handles comprising:

at least one front handle connected to a front of the first outline weave, at least one back handle connected to a back of the first outline weave, and at least two side handles connected on each side of the first outline weave, the front handle and back handle connecting to each other via a support weave within the webbing and each side handle connecting to its respective opposing side handle via additional support weaves within the webbing, the support weaves being the same material as the first outline weave;

a plurality of loops, each loop surrounding an outer perimeter of a respective side handle such that each loop is directly connected to its respective side handle at the first outline weave but each side handle is directly positioned between the first outline weave and its respective loop;

a commode interposed within the webbing; and a second outline weave forming a closed perimeter surrounding the commode, the support weave connecting the front handle to the back handle being directly connected to the closed perimeter of the second outline weave, the second outline weave being the same material as the first outline weave.

14. The portable chair of claim 13, wherein the plurality of handles comprises an additional side handle on each side of the first outline weave.

15. The portable chair of claim 13, wherein the webbing comprises a water resistant polypropylene webbing.

16. The portable chair of claim 13, further comprising a plurality of buckles connected to the webbing for securing the individual.

17. The portable chair of claim 13, wherein the first and second outline weaves and support weaves comprise an open weave with non-wick stitching.

* * * * *